US012416137B2

(12) United States Patent
Bijnens

(10) Patent No.: US 12,416,137 B2
(45) Date of Patent: Sep. 16, 2025

(54) SANITARY SYSTEM FOR INSTANT HOT WATER

(71) Applicant: HEAU BV, Bilzen (BE)

(72) Inventor: Philippe Hendrik A. Bijnens, Bilzen (BE)

(73) Assignee: HEAU BV, Bilzen (BE)

( * ) Notice: Subject to any disclaimer, the term of this patent is extended or adjusted under 35 U.S.C. 154(b) by 222 days.

(21) Appl. No.: 18/480,629

(22) Filed: Oct. 4, 2023

(65) Prior Publication Data

US 2024/0117611 A1 Apr. 11, 2024

(30) Foreign Application Priority Data

Oct. 5, 2022 (BE) ..... 2022/5798

(51) Int. Cl.
*E03B 1/04* (2006.01)
*E03B 7/04* (2006.01)

(52) U.S. Cl.
CPC ..... *E03B 1/048* (2013.01); *E03B 7/045* (2013.01)

(58) Field of Classification Search
CPC ..... E03B 1/048; E03B 7/045
See application file for complete search history.

(56) References Cited

U.S. PATENT DOCUMENTS

2010/0290763 A1* 11/2010 Boulay ..... F24H 15/164 219/494
2024/0167726 A1* 5/2024 Yemm ..... F28F 9/22
2025/0146706 A1* 5/2025 Yin ..... F24H 9/133

FOREIGN PATENT DOCUMENTS

AT 500552 B1 8/2009
EP 2706154 A1 3/2014
WO 2012001683 A2 1/2012

OTHER PUBLICATIONS

Search Report and Written Opinion for Application No. BE202205798, dated May 23, 2023, 08 pages.

* cited by examiner

*Primary Examiner* — Henry T Crenshaw
(74) *Attorney, Agent, or Firm* — KDW Firm PLLC

(57) ABSTRACT

A sanitary water storage device configured to store and supply sanitary hot water includes a housing with a first reservoir and a second reservoir. A volume of the first reservoir and a volume of the second reservoir are modifiable proportionally to each other. A water distributing means includes an inlet, a first outlet and a second outlet, which first outlet is in liquid connection with the first reservoir and the second outlet is in liquid connection with the second reservoir. Depending on a liquid temperature measured at the inlet, the water distributing means is configured to to bring the inlet into liquid connection with the first outlet or the second outlet.

17 Claims, 4 Drawing Sheets

SANITARY SYSTEM FOR INSTANT HOT WATER

CROSS-REFERENCE TO RELATED APPLICATION

This U.S. nonprovisional application claims priority to pending Belgian national patent application serial number BE2022/5798, filed Oct. 5, 2022, the entirety of which application is incorporated by reference herein.

FIELD OF THE INVENTION

The invention relates to a sanitary system for instantly providing hot water to a user.

BACKGROUND

Sanitary systems such as a shower system, bath taps, sinks and so on are already known from the prior art.

A problem that occurs in use of these systems is that, particularly when there is a great distance between the hot water source (for instance combustion device or boiler) and the sanitary system, the hot water feed in the sanitary system will supply cold water to begin with. Depending on the distance between the hot water source and the sanitary system it is possible that hot water will only be supplied at the desired temperature once the water has run for a relatively long time. The cold water from the feed line between hot water source and sanitary system is typically discharged until this hot water is supplied. A large amount of water is thus discharged unused, which results in waste.

SUMMARY OF THE INVENTION

Embodiments of the invention have for their object to provide a device which is configured to limit water waste and is configured to supply hot water instantly.

The invention provides for this purpose a sanitary water storage device configured to store and supply sanitary hot water. The storage device comprises a housing with a first reservoir and a second reservoir, each respectively provided with an inlet and an outlet, wherein a volume of the first reservoir and a volume of the second reservoir are modifiable proportionally to each other inside the volume of the housing. The storage device further comprises a water distributing means with an inlet, a first outlet and a second outlet. The inlet is configured to be connectable to a hot water feed conduit. The first outlet is in liquid connection with the first reservoir by means of the inlet of the first reservoir and the second outlet is in liquid connection with the second reservoir by means of the inlet of the second reservoir. The water distributing means is here configured to bring the inlet into liquid connection with the first outlet or the second outlet, depending on a liquid temperature measured at the inlet. When the liquid temperature is equal to or higher than a predetermined threshold value, the water distributing means brings the inlet into liquid connection with the first reservoir, such that the first reservoir is filled. This results in an increase of the volume of the first reservoir and a proportional decrease of the volume of the second reservoir. When the liquid temperature is lower than the predetermined threshold value, the water distributing means brings the inlet into liquid connection with the second reservoir. This results in an increase of the volume of the second reservoir and in a proportional decrease of the first reservoir.

The advantage of the water storage device according to the invention is based on the insight that when the water is hot, i.e. when the temperature at the inlet is higher than or equal to the predetermined threshold value, the hot water fills the first reservoir and can be used by a user. With this, the volume of the first reservoir increases and the first reservoir stores hot water. Inside the volume of the housing the available volume of the second reservoir decreases correspondingly, which causes a pressure exerted by the hot water flowing into the first reservoir on the second reservoir. The volume of the second reservoir will decrease proportionally under the influence of this pressure. The first and the second reservoir can thus for instance take the form of a flexible balloon arranged in the housing. When the one balloon swells up due to being filled with water, the other balloon will have less space in the housing and will push the water present therein out of the housing. When a user then stops consuming hot water, for instance when a shower has ended, the hot water remains stored in the first reservoir. The next time the sanitary system is used, for instance a day later when the user wishes to shower once again, the cycle of supplying water from the heating boiler starts over and, when the temperature at the inlet is still lower than the predetermined threshold value, the water distributing means will bring the cold water of the inlet into connection with the second reservoir. The second reservoir will then initially be filled with cold water and increase in volume. Inside the volume of the housing the available volume of the second reservoir decreases correspondingly, which causes a pressure exerted by the cold water flowing into the second reservoir on the first reservoir. Under the influence of this pressure the volume of the first reservoir will decrease proportionally, releasing the hot water which is still stored in the first reservoir following the previous use to the user so that the user can enjoy hot water instantly. As soon as the water coming from the boiler reaches the water distributing means and has a temperature which is higher than or equal to the predetermined threshold value, said cycle is repeated and the water distributing means will bring the inlet into liquid connection with the first reservoir and provide the first reservoir, and therefore the user as well, with hot water. In this way the hot water in the first reservoir is replenished again and the hot water from the previous use can be used instantly in a subsequent use. This allows wastage of cold water to be limited to a minimum and allows instant provision of hot water to the user, this considerably enhancing the user experience. This further makes it possible to prevent a heat source, such as a boiler, from starting up for every small consumption flow rate. In this way the heat source is thus also used in improved manner.

The water storage device preferably comprises a partition which is provided movably between the first reservoir and the second reservoir. This allows the water storage device to take the form of a type of hydraulic cylinder wherein the volume on the one side of the partition, for instance the first reservoir, is directly influenced by the volume on the other side of the partition. Such a setup is robust because it has a limited number of moving parts and can moreover be produced in relatively simple manner. The partition more preferably comprises a seal which seals the first reservoir substantially watertightly relative to the second reservoir. In this way any potential leakage from the first reservoir to the second reservoir is substantially avoided, whereby the water storage device can store the hot water in improved manner. The partition more preferably comprises an insulating material. This allows the first reservoir and the second reservoir to be insulated from each other in further improved manner, whereby the hot water is further stored in improved manner.

The housing preferably comprises an insulating material. It is important on one hand for the water storage device to be insulated in order to preserve the thermal energy of the hot water in the first reservoir. It is on the other hand not essential for the housing to comprise insulating material. Insulating material can thus also be provided outside the housing, glass wool or insulating foam arranged all around the housing can for instance insulate the first reservoir from the external environment in relatively simple manner. When the housing comprises insulating material, the water storage device will be able to insulate the first reservoir and the second reservoir from the external environment in improved manner. The insulating material preferably has a lambda value below 0.02 W/mK, more preferably below 0.015 W/mK, still more preferably below 0.01 W/mK. Tests have shown that hot water that is stored inside the housing with said lambda value will only decrease in temperature within a determined range, for instance about 5° per 24 hours. A boiler typically heats water to about 60° C., a user requiring hot water typically does not require such a high temperature. A user can thus for instance already comfortably shower or bathe in water of about 40° C. When the hot water thus only decreases in temperature within a limited range, the hot water from a previous period of use can still be used optimally for a new period of use.

A housing wall which bounds the first and the second reservoir is preferably a double wall formed by two wall parts, wherein an at least partial vacuum prevails between the two wall parts. Such a preferred embodiment limits the number of cold bridges considerably, whereby the first reservoir and the second reservoir are insulated from the surrounding area in further improved manner.

The first reservoir preferably has a first reservoir outlet which is connectable to a sanitary system, also referred to hereinafter as external consumer, such as a mixer tap. This the allows water storage device to be connected to an external consumer in simple manner. The first reservoir outlet is more preferably insulated in order to limit cold bridges between the first reservoir and an external environment.

The second reservoir preferably has a second reservoir outlet which is connectable to an external consumer, such as a mixer tap. This the allows water storage device to be connected to an external consumer in simple manner. The second reservoir outlet is preferably connected to a cold water feed conduit of an external user. When the first reservoir fills up with hot water, the cold water from the second reservoir will thus be supplied to the cold water feed of the external user. The water storage device more preferably further comprises a non-return valve provided between the second reservoir outlet and cold water feed conduit of the external consumer, wherein the non-return valve allows a liquid flow in only one direction away from the second reservoir. In this way the second reservoir outlet of the water storage device can be connected to a cold water feed conduit without the cold water being able to flow directly into the second reservoir. The water storage device more preferably further comprises a cold water inlet which is configured to be connectable to a cold water feed conduit, wherein the water storage device further preferably comprises a priority valve between the non-return valve and the cold water inlet, wherein the priority valve is configured to give priority to a liquid flow coming from the second reservoir over a liquid flow coming from the cold water inlet. A hydrodynamic equilibrium of the water storage device, and consequently the sanitary system, is preserved in this way. The water can thus flow from the second reservoir to the user without cold water having a direct influence thereon. When the second reservoir is empty, the priority valve can prioritize the liquid flow coming from the cold water inlet and allow a liquid flow therefrom to the user.

The water storage device preferably comprises a heating element which is configured to heat the water in the first reservoir at least partially. This allows the water in the first reservoir to be stored at relatively high temperature, for instance when there is a considerable period of time between periods of use of the sanitary system.

The volume of the first reservoir and the second reservoir together is preferably at least 3 litres, preferably at least 5 litres. Tests have shown that, from the boiler to a consumer located furthest from the boiler, hot water needs about 1 minute to reach the user in the average household. By providing a volume of at least 3 litres sufficient hot water is present in the water storage device, even in the case of consumers with a high flow rate such as a rain shower, to buffer the transition from the heat source to the user with the water storage device.

At least one of the first and the second reservoir is preferably in liquid connection with a legionella flushing device. The advantage hereof is based on the insight that growth of legionella can be prevented in warm, typically still water. By providing a legionella flushing device both the first reservoir and the second reservoir can be purged in order to clean the first reservoir and/or the second reservoir. The legionella flushing device can for instance be a bypass which brings the hot water feed conduit into direct liquid connection with the second reservoir. The legionella flushing device can also comprise an inlet which allows cleaning agent, for instance a chlorine tablet, to be inserted into the water storage device. The water storage device preferably comprises an electronic monitoring system for monitoring the temperature in the reservoirs in order to prevent growth of legionella.

According to a further aspect, the invention provides a sanitary system comprising a water storage device as described above, a thermostatic control device with a discharge conduit, a hot water feed conduit and a cold water feed conduit, wherein the hot water feed conduit is connected to the inlet of the water storage device which is connected downstream to the thermostatic control device via the first reservoir, and wherein the cold water feed conduit is connected to the thermostatic control device.

The above stated advantages of the water storage device apply mutatis mutandis for the sanitary system.

BRIEF DESCRIPTION OF THE FIGURES

The above stated and other advantageous features and objects of the invention will become more apparent, and the invention better understood, on the basis of the following detailed description when read in combination with the accompanying drawings, in which.

DETAILED EMBODIMENTS

Figure 1:
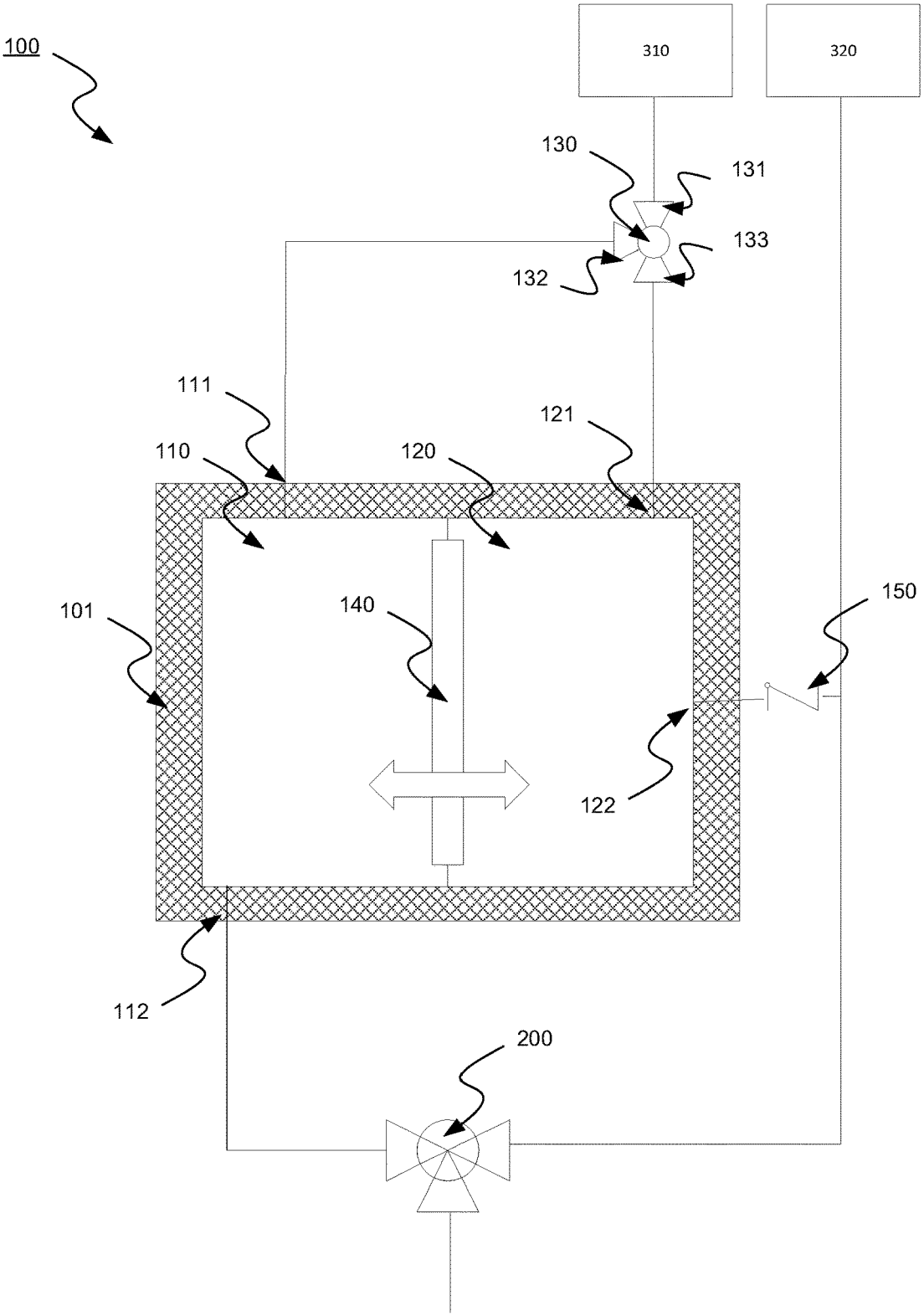
FIG. 1 is a schematic representation of a sanitary system with a water storage device according to a preferred embodiment.

The following detailed description relates to determined specific embodiments. The teaching hereof can however be applied in different ways. The same or similar elements are designated in the drawings with the same reference numerals.

The present invention will be described with reference to specific embodiments. The invention is however not limited thereto, but solely by the claims.

As used here, the singular forms "a" and "the" comprise both the singular and plural references, unless clearly indicated otherwise by the context.

The terms "comprising", "comprises" and "composed of" as used here are synonymous with "including". The terms "comprising", "comprises" and "composed of" when referring to stated components, elements or method steps also comprise embodiments which "consist of" the components, elements or method steps.

The terms first, second, third and so on are further used in the description and in the claims to distinguish between similar elements and not necessarily to describe a sequential or chronological order, unless this is specified. It will be apparent that the thus used terms are mutually interchangeable under appropriate circumstances and that the embodiments of the invention described here can operate in an order other than described or illustrated here.

Reference in this specification to "one embodiment", "an embodiment", "some aspects", "an aspect" or "one aspect" means that a determined feature, structure or characteristic described with reference to the embodiment or aspect is included in at least one embodiment of the present invention. The manifestations of the sentences "in one embodiment", "in an embodiment", "some aspects", "an aspect" or "one aspect" in different places in this specification thus do not necessarily all refer to the same embodiment or aspects. As will be apparent to a skilled person in this field, the specific features, structures or characteristics can further be combined in any suitable manner in one or more embodiments or aspects. Although some embodiments or aspects described here comprise some but no other features which are included in other embodiments or aspects, combinations of features of different embodiments or aspects are further intended to fall within the context of the invention and to form different embodiments or aspects, as would be apparent to the skilled person. In the appended claims all features of the claimed embodiments or aspects can for instance be used in any combination.

The same or similar elements are designated in the figures with the same reference numerals.

Figure 2:
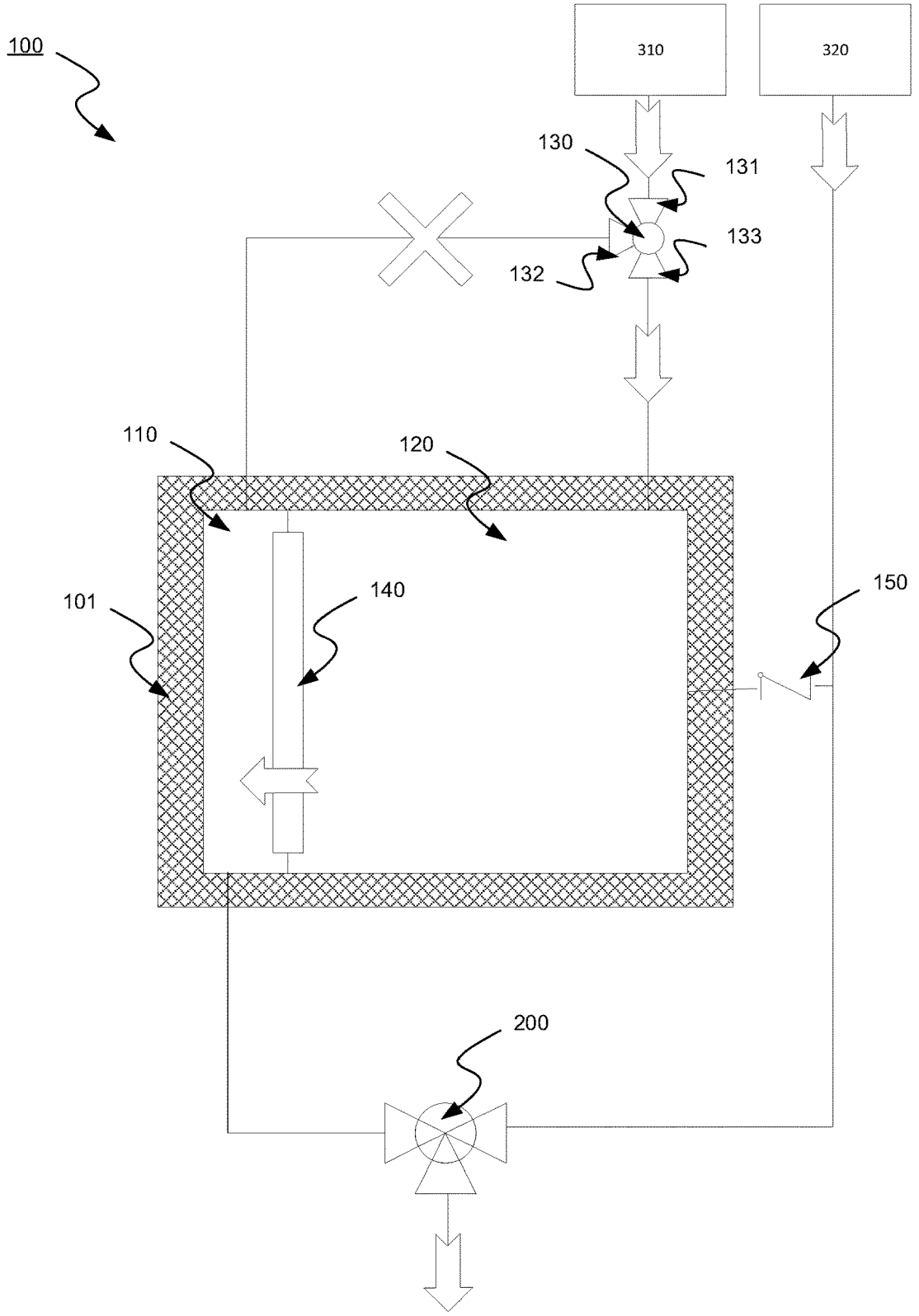
FIG. 2 is a schematic representation of the sanitary system according to FIG. 1 where the second reservoir is being filled.
Figure 3:
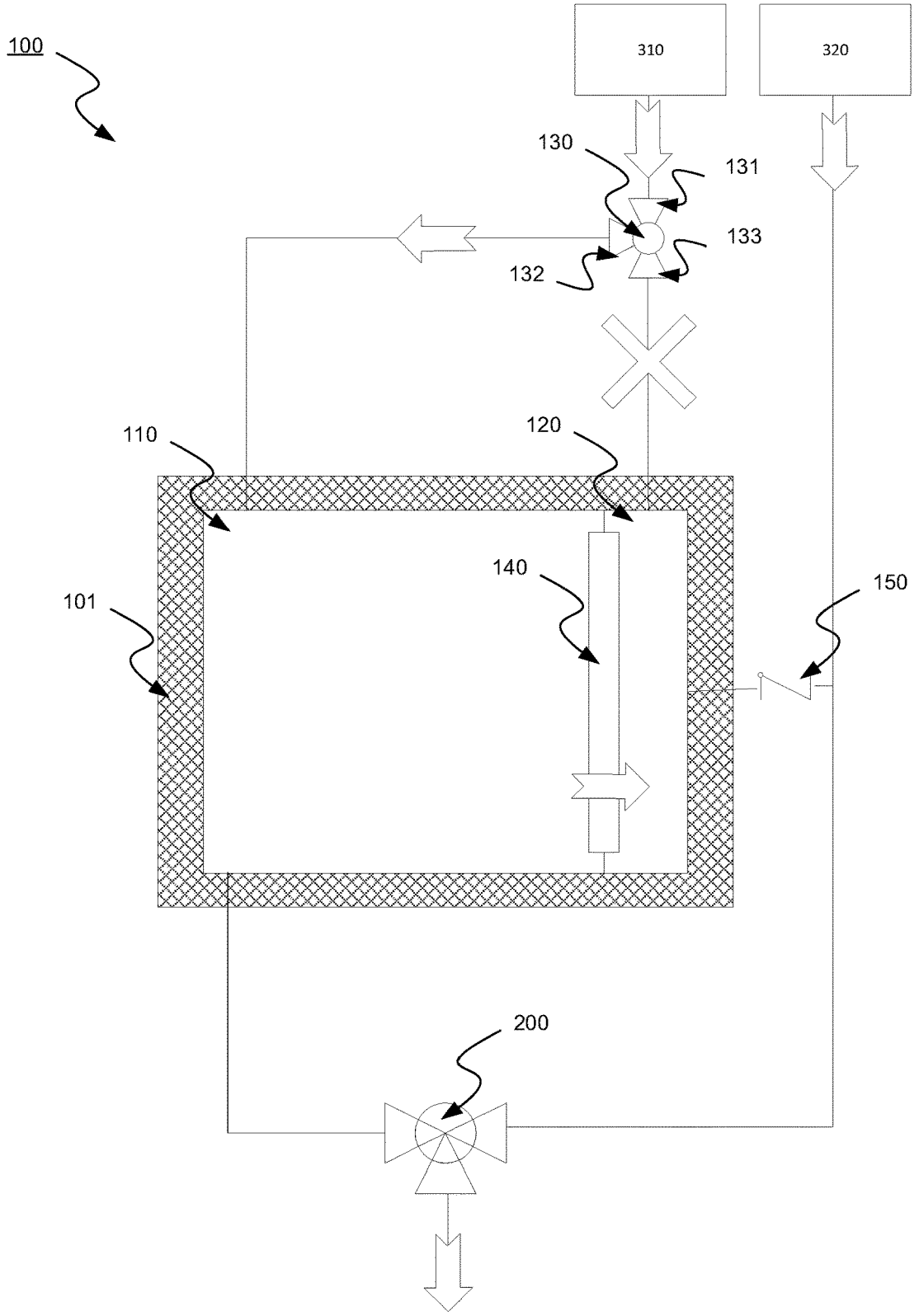
FIG. 3 is a schematic representation of a sanitary system with a water storage device according to FIG. 1 where the first reservoir is being filled.

FIG. 1 shows schematically a sanitary water storage device 100 according to a preferred embodiment, configured to store and supply sanitary hot water. FIGS. 2 and 3 show an operating principle of the embodiment shown in FIG. 1. When describing the sanitary water storage device 100 according to FIG. 1, FIGS. 2 and 3 will be used to elucidate the operating principles of the water storage device 100. Sanitary hot water is typically used for personal care but also for other cleaning actions, such as washing up crockery, cutlery or cookware, or general cleaning tasks. The hot water typically comes from a hot water source such as a boiler, central heating boiler or a combination thereof. To produce sanitary hot water the boiler heats cold water to a predetermined temperature, typically about 60 to 65° C. The sanitary water storage device 100 can thus for instance be used in combination with the mixer tap of a bath, bidet, shower or sink. The water storage device 100 can further for instance also be used between a hot water collector and the user in order to shorten the time spent waiting for hot water. It will further be apparent that these examples are not intended to be limitative and that other sanitary installations, also referred to here as sanitary systems or external consumers, which use sanitary hot water can also be used in combination with the sanitary water storage device 100. In FIGS. 1, 2, 3 and 4 hot water is fed to the sanitary water storage device 100 with a hot water feed conduit 310. The sanitary water storage device 100 can also be connected to a cold water feed conduit, which is designated with reference numeral 320.

The sanitary water storage device 100, also shortened to storage device 100, comprises a housing 101. The housing 101 has a first reservoir 110 and a second reservoir 120, wherein a volume of the first reservoir 110 and a volume of the second reservoir 120 are modifiable proportionally to each other. This means that each of first reservoir 110 and second reservoir 120 has a volume, also referred to respectively as first volume for first reservoir 110 and second volume for second reservoir 120, which is modifiable. This is understood to mean that the volume of the first reservoir 110 and second reservoir 120 is variable and may therefore increase in volume, as well as decrease in volume. The volume of first reservoir 110 can thus for instance increase from an initial volume of 10 l to a volume of 20 l, as shown in FIG. 3. The volume of first reservoir 110 can further for instance also decrease from an initial volume of 10 l to a volume of 1 l, as shown in FIG. 2. It is noted here that the volume of first reservoir 110 is modifiable proportionally to second reservoir 120, and vice versa. This means that when the volume of first reservoir 110 increases, the volume of second reservoir 120 decreases correspondingly, and vice versa. When the volume of second reservoir 120 increases, the volume of first reservoir 110 will decrease correspondingly, and vice versa. Such reservoirs can be given different forms, for instance the form of a balloon; a form using a movable partition between first reservoir 110 and second reservoir 120, as will be elucidated below; or a form with a flexible membrane between first reservoir 110 and second reservoir 120. When the one reservoir is being filled, such a flexible membrane can for instance be urged in a direction of the other reservoir inside the volume of the housing due to the increasing volume of the one reservoir. The volume of first reservoir 110 and second reservoir 120 together is preferably at least 3 litres, preferably at least 5 litres. Tests have shown that, from the boiler to a consumer located furthest from the boiler, hot water needs about 1 minute to reach the user in the average household. By providing a volume of at least 8 litres, sufficient hot water is present in water storage device 100, even in the case of consumers with a high flow rate, such as a rain shower. Only a limited quantity of hot water is thus needed to obtain a hot water temperature which is pleasant for the body, for instance when showering, since the hot water is still being mixed with cold water.

Storage device 100 further comprises a water distributing means 130 with an inlet 131, a first outlet 132 and a second outlet 133. The inlet 131 is configured to be connectable to a hot water feed conduit 310. Inlet 131 can for this purpose be provided with for instance a flange connection, screw thread connection or press fit which allows the storage device 100 to be connected to the hot water feed conduit in simple manner. It is noted here that a welded connection is not precluded either.

FIG. 1 further shows that first outlet 132 is in liquid connection with first reservoir 110, for instance by means of a conduit extending from first outlet 132 to first reservoir 110. The first reservoir 110 can for this purpose be provided with a first reservoir inlet 111. The second outlet 132 is in liquid connection with the second reservoir 120, for instance by means of a conduit extending from second outlet 133 to second reservoir 120. The second reservoir 120 can for this purpose be provided with a second reservoir inlet 121. The water distributing means 130 is configured to bring inlet 131 into liquid connection with first outlet 132 or second outlet 133, depending on a liquid temperature measured at the inlet. When the liquid temperature is equal to or higher than a predetermined threshold value, for instance 45° C., the water distributing means 130 brings inlet 131 into liquid connection with first reservoir 110, such that first reservoir 110 is filled. This can be done with a thermostatic control valve which determines the flow direction on the basis of a bimetal or using an electronic sensor. Inside the volume of the housing this results in an increase of the volume of first reservoir 110 and a proportional decrease of the volume of second reservoir 120. This situation is shown in FIG. 3. When the liquid temperature is lower than the predetermined threshold value, the water distributing means brings inlet 131 into liquid connection with the second reservoir. Inside the volume of the housing this results in an increase of the volume of second reservoir 120 and in a proportional decrease of the volume of first reservoir 110. This situation is shown in FIG. 2. The operating principle of storage device 100 is elucidated as follows, in the context of the example of a person showering. When a user showers and the water is hot, i.e. when the temperature at inlet 131 is for instance higher than the threshold value of 45° C., the hot water will be fed to first reservoir 110 and fill first reservoir 110. With this, the volume of first reservoir 110 increases and first reservoir 110 simultaneously stores hot water. This is referred to as a filling stage of the first reservoir 110. Inside the volume of the housing the volume of second reservoir 120 decreases correspondingly during the filling stage. Within the boundary of the housing this is realized by a pressure exerted by the hot water flowing into first reservoir 110 on second reservoir 120. During the filling stage a portion of the hot water can also be used by the user. When a user then stops consuming hot water, for instance when the shower has ended, the hot water remains stored in first reservoir 110. The cycle of feeding water from the heating boiler starts over with a subsequent shower, for instance the next day. The water in the hot water conduit will then typically have cooled down. When the temperature at inlet 131 is still lower than the predetermined threshold value, 50° C. according to the stated example, the water distributing means 130 will hereby bring the cold water of inlet 131 into connection with second reservoir 120. Second reservoir 120 will initially be filled with cold water and increase in volume, as shown in FIG. 2. Inside the volume of the housing first reservoir 110 decreases correspondingly to the increase of second reservoir 120. This decrease pushes the hot water, which is still stored in first reservoir 110 after the previous use, to the user so that the user can instantly enjoy hot water. As soon as the water coming from the boiler reaches the water distributing means and has a temperature which is higher than or equal to the predetermined threshold value, the water distributing means 130 will bring inlet 131 into liquid connection with first reservoir 110 and provide the first reservoir 110, and therefore the user as well, with hot water. In this way the hot water in first reservoir 110 is replenished again and the hot water that was stored during the previous shower can be used instantly in a subsequent shower. This allows wastage of cold water to be limited to a minimum and allows instant provision of hot water to the user, this considerably enhancing the user experience. It will be apparent that the above described operating principle is also applicable in use of any sanitary system that uses hot water, such as a sink, a bath, or when filling a collector and so on.

FIG. 1 shows that the water storage device 100 can comprise a partition 140 which is provided movably between first reservoir 110 and second reservoir 120. The housing 101 can for instance define one volume, which volume separates into a first reservoir 110 and a second reservoir 120 by means of partition 140. Because partition 140 is movable, a modification of the volume of first reservoir 110 also results in a proportional modification of the volume of second reservoir 120. This allows the housing of the water storage device to take the form of a hydraulic cylinder, wherein the volume on one side of the partition 140, for instance the first reservoir 110, is directly influenced by the volume on the other side of partition 140. Such a setup is robust because it has a limited number of moving parts and can moreover be produced in relatively simple manner. In order to avoid any leakage from first reservoir 110 to second reservoir 120 the partition 140 can comprise a seal which seals first reservoir 110 substantially water-tightly relative to second reservoir 120. In this way the water storage device 100 can store the hot water in improved manner. The partition can comprise an insulating material for insulating first reservoir 110 and second reservoir 120 from each other in further improved manner, whereby the hot water is further stored in improved manner.

FIG. 1 further shows that housing 101 preferably comprises an insulating material. It is important on one hand for water storage device 100 to be insulated in order to preserve the thermal energy of the hot water in first reservoir 110. It is on the other hand not essential for the housing to comprise insulating material. Insulating material can thus also be provided outside the housing 110, glass wool or insulating foam arranged all around the housing can for instance insulate the housing and/or the first reservoir from the external environment in relatively simple manner, which embodiment is however not shown. When housing 101 comprises insulating material, the water storage device 100 will be able to insulate first reservoir 110 and second reservoir 120 from the external environment in improved manner. The insulating material preferably has a lambda value below 0.02 W/mK, more preferably below 0.015 W/mK, still more preferably below 0.01 W/mK. Tests have shown that hot water that is stored inside housing 101 with said lambda value will only decrease in temperature within a determined range, for instance about 5° per 24 hours. A boiler typically heats water to about 60° C., a user requiring hot water typically does not require such a high temperature. A user can thus for instance already comfortably shower or bathe in water of about 40° C. When the hot water thus only decreases in temperature within a limited range, the hot water from a previous period of use can still be used optimally for a new period of use. The selected insulating material is preferably a type of material which only allows a maximum temperature drop of 20° C. over a time period of 72 hours.

Alternatively or in combination, housing 101 can be formed from a double-walled housing wall which is formed by two wall parts. An at least partial vacuum prevails between the two wall parts, which functions as thermal insulation similar to a double-walled insulating container. Such a preferred embodiment limits the number of cold bridges considerably, whereby first reservoir 110 and second reservoir 120 are insulated from the surrounding area in further improved manner.

FIG. 1 further shows that first reservoir 110 has a first reservoir outlet 112 which is connectable to an external consumer, such as a mixer tap 200. This the allows water storage device 100 to be connected to an external consumer in simple manner, the mixer tap 200 can for instance further be connected to a rain shower head. Second reservoir 120 can also have a second reservoir outlet 122 which is connectable to the external consumer 200, preferably by means of the cold water feed conduit 320 of the external consumer. It is preferred here for the water storage device 100 to further comprise a non-return valve 150 provided between the second reservoir outlet 122 and the external consumer, wherein the non-return valve allows a liquid flow in only one direction away from the second reservoir. In this way the water storage device 100 can further be connected to a cold water feed conduit 320 without the cold water being able to flow directly into the second reservoir 120.

Figure 4:
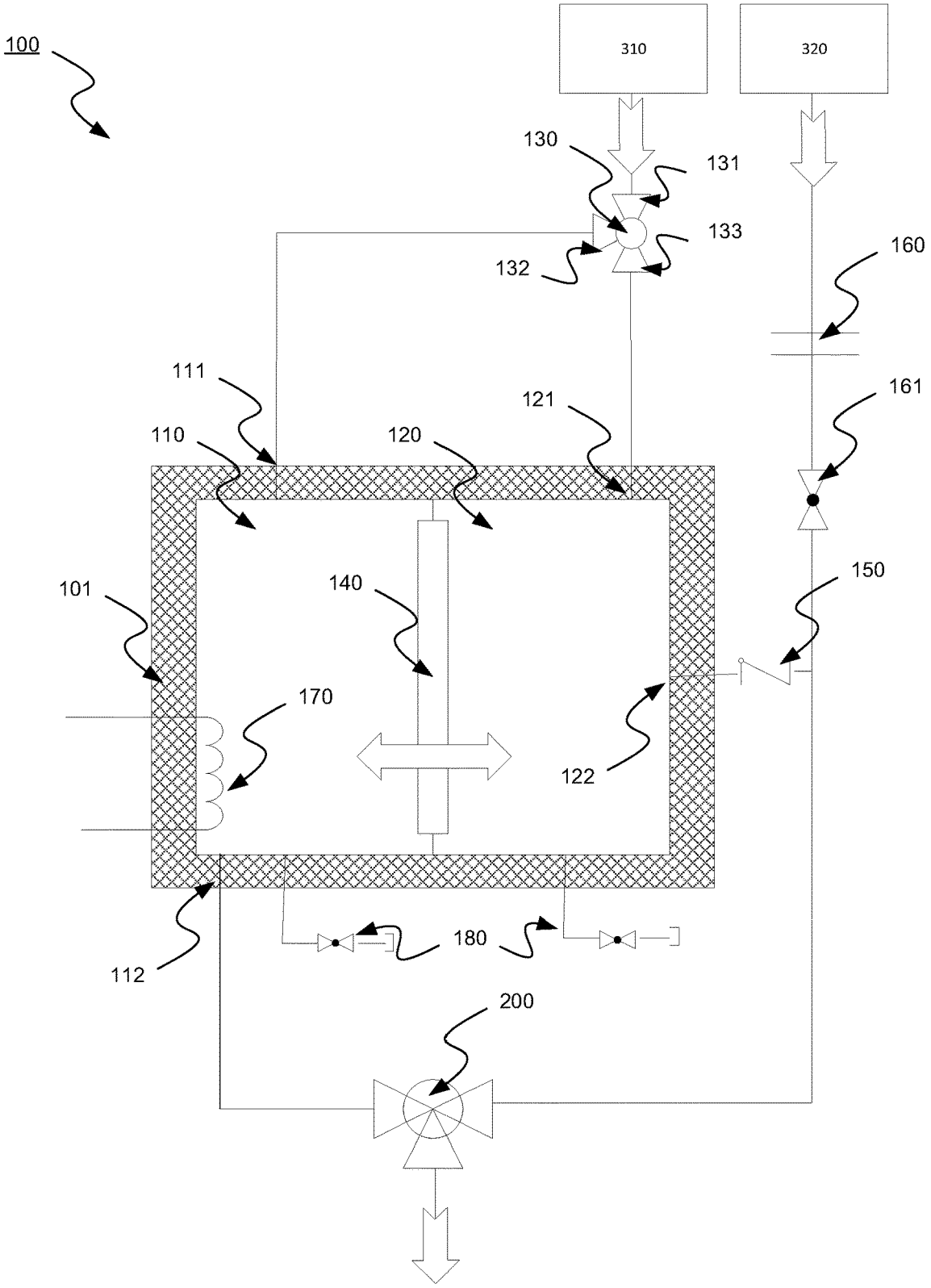
FIG. 4 is a schematic representation of a sanitary system with a water storage device according to a further preferred embodiment.

FIG. 4 shows a schematic representation of a sanitary system with a water storage device 100 according to a further preferred embodiment.

In order to connect the water storage device 100 to a cold water feed conduit 320 the water storage device 100 further comprises the cold water inlet 160 in this preferred embodiment. The cold water inlet 160 is illustrated in FIG. 4 as a flange connection, but can also be a screw thread connection or welded connection. The water storage device 100 preferably further comprises here a priority valve 161 between the non-return valve 150 and the cold water inlet 160. The priority valve 161 is configured to give priority to a liquid flow coming from the second reservoir 120 over a liquid flow coming from the cold water inlet 160. A hydrodynamic equilibrium of the water storage device, and consequently the sanitary system, is preserved in this way. The water can thus flow from second reservoir 120 to the user without cold water coming from the cold water inlet 160 having a direct influence thereon. When second reservoir 120 is empty or almost empty, i.e. in a situation as shown in FIG. 3, priority valve 161 can prioritize the liquid flow coming from the cold water inlet 160 and allow a liquid flow therefrom to the user. Such a priority valve can for instance be an overflow valve which determines on the basis of a liquid pressure on the user side which liquid flow has priority. When, in the filling stage, first reservoir 110 is being filled and the cold water is being pushed out of second reservoir 120, the pressure at the position of the consumer, i.e. downstream of non-return valve 150, will be relatively high. When first reservoir 110 is filled and thus cannot increase any further in volume, the flow rate of the liquid flow coming from second reservoir 120 decreases and the pressure downstream of non-return valve 150 will decrease. On the basis of this pressure drop an overflow valve can prioritize a liquid flow from the cold water inlet 160.

FIG. 4 further shows that the water storage device 100 can comprise a heating element 170 which is configured to heat the water in first reservoir 110 at least partially. This allows the water in the first reservoir to be stored at relatively high temperature, for instance when there is a considerable period of time between periods of use of the sanitary system. When water storage device 100 is used daily, such a heating element 170 is however not needed.

At least one of first reservoir 110 and second reservoir 120 is preferably in liquid connection with a legionella flushing device 180. The advantage hereof is based on the insight that growth of legionella can be prevented in warm, typically still water. By providing a legionella flushing device 180 both the first reservoir and the second reservoir can be purged in order to clean the first reservoir and/or the second reservoir.

The skilled person will appreciate on the basis of the above description that the invention can be embodied in different ways and on the basis of different principles. The invention is not limited to the above described embodiments. The above described embodiments and the figures are purely illustrative and serve only to increase understanding of the invention. The invention will not therefore be limited to the embodiments described herein, but is defined in the claims.

The invention claimed is:

1. A sanitary water storage device configured to store and supply sanitary hot water, the water storage device comprising:

a housing with a first reservoir and a second reservoir, each respectively provided with an inlet and an outlet, wherein a volume of the first reservoir and a volume of the second reservoir are modifiable proportionally to each other inside the volume of the housing;

a water distributing means comprising an inlet, a first outlet and a second outlet, which inlet is configured to be connectable to a hot water feed conduit, the first outlet is in liquid connection with the first reservoir and the second outlet is in liquid connection with the second reservoir, wherein the water distributing means is configured to bring the inlet into liquid connection with the first outlet or the second outlet, depending on a liquid temperature measured at the inlet.

2. The sanitary water storage device according to claim 1, wherein the water distributing means is configured such that when the liquid temperature is equal to or higher than a predetermined threshold value, the first reservoir is filled, which results in a volume increase of the first reservoir and a volume decrease of the second reservoir and, when the liquid temperature is lower than the predetermined threshold value, the second reservoir is filled, which results in a volume increase of the second reservoir and a volume decrease of the first reservoir.

3. The water storage device according to claim 1, wherein a modification of the volume of the first reservoir results in a proportional modification of the volume of the second reservoir, and vice versa.

4. The water storage device according to claim 1, further comprising a partition which is provided movably between the first reservoir and the second reservoir.

5. The water storage device according to claim 1, wherein the partition comprises a seal which seals the first reservoir substantially watertightly relative to second reservoir.

6. The water storage device according to claim 4, wherein the partition comprises an insulating material.

7. The water storage device according to claim 1, wherein the housing comprises an insulating material.

8. The water storage device according to claim 6, wherein the insulating material has a lambda value below 0.02 W/mK.

9. The water storage device according to claim 1, wherein a housing wall which bounds the first and the second reservoir is a double wall formed by two wall parts, wherein an at least partial vacuum prevails between the two wall parts.

10. The water storage device according to claim 1, wherein the first reservoir has a first reservoir outlet which is connectable to an external consumer.

11. The water storage device according to claim 1, wherein the second reservoir has a second reservoir outlet which is connectable to an external consumer, such as a mixer tap.

12. The water storage device according to claim 11, further comprising a non-return valve provided between the second reservoir outlet and the external consumer; wherein the non-return valve allows a liquid flow in only one direction away from the second reservoir.

13. The water storage device according to claim 12, wherein the water storage device further comprises a cold water inlet which is configured to be connectable to a cold water feed conduit, wherein the water storage device further comprises a priority valve between the non-return valve and the cold water inlet, wherein the priority valve is configured to give priority to a liquid flow coming from the second reservoir over a liquid flow coming from the cold water inlet.

14. The water storage device according to claim 1, further comprising a heating element configured to heat the water in the first reservoir at least partially.

15. The water storage device according to claim 1, wherein the volume of the first reservoir and the second reservoir together is at least 3 litres.

16. The water storage device according to claim 1, wherein at least one of the first and the second reservoir is in liquid connection with a legionella flushing device.

17. A sanitary system comprising a water storage device according to claim 1, a thermostatic control device with a discharge conduit, a hot water feed conduit and a cold water feed conduit, wherein the hot water feed conduit is connected to the inlet of the water storage device which is connected downstream to the thermostatic control device via the first reservoir, and wherein the cold water feed conduit is connected to the thermostatic control device.

* * * * *